US006224505B1

(12) United States Patent
Burger

(10) Patent No.: US 6,224,505 B1
(45) Date of Patent: May 1, 2001

(54) HOCKEY STICK SHAFT

(75) Inventor: George W. Burger, Rocklin, CA (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 09/391,996

(22) Filed: Sep. 8, 1999

(51) Int. Cl.[7] ..... A63B 59/14
(52) U.S. Cl. ..... 473/561
(58) Field of Search ..... 473/560–563

(56) References Cited

U.S. PATENT DOCUMENTS 3,638,942 * 2/1972 Bassett ..... 473/562
5,217,221 6/1993 Baum .
5,312,100 * 5/1994 Ilacqua et al. ..... 473/562
5,607,154 * 3/1997 Meumann et al. ..... 473/562
5,823,901 10/1998 Burger .

* cited by examiner

*Primary Examiner*—Mark S. Graham
(74) *Attorney, Agent, or Firm*—James C. Eaves, Jr.; Greenebaum Doll & McDonald PLLC

(57) ABSTRACT

The present invention relates to a hockey stick shaft. The shaft includes a core of rectangular cross-section running the full length of the shaft. A cloth fabric, such as an aramid fiber cloth, is wrapped around the perimeter of the core and extends from the shaft blade end at least partways toward the shaft opposed end. A wood veneer is then wrapped around the core/cloth fabric and extends from the shaft opposed blade end at least partways toward the shaft blade end, with a space between the end of the wood veneer and the shaft blade end where the cloth fabric is exposed. This permits heat to be applied to the shaft for removal and/or insertion of a blade without the heat damaging the wood veneer.

20 Claims, 5 Drawing Sheets

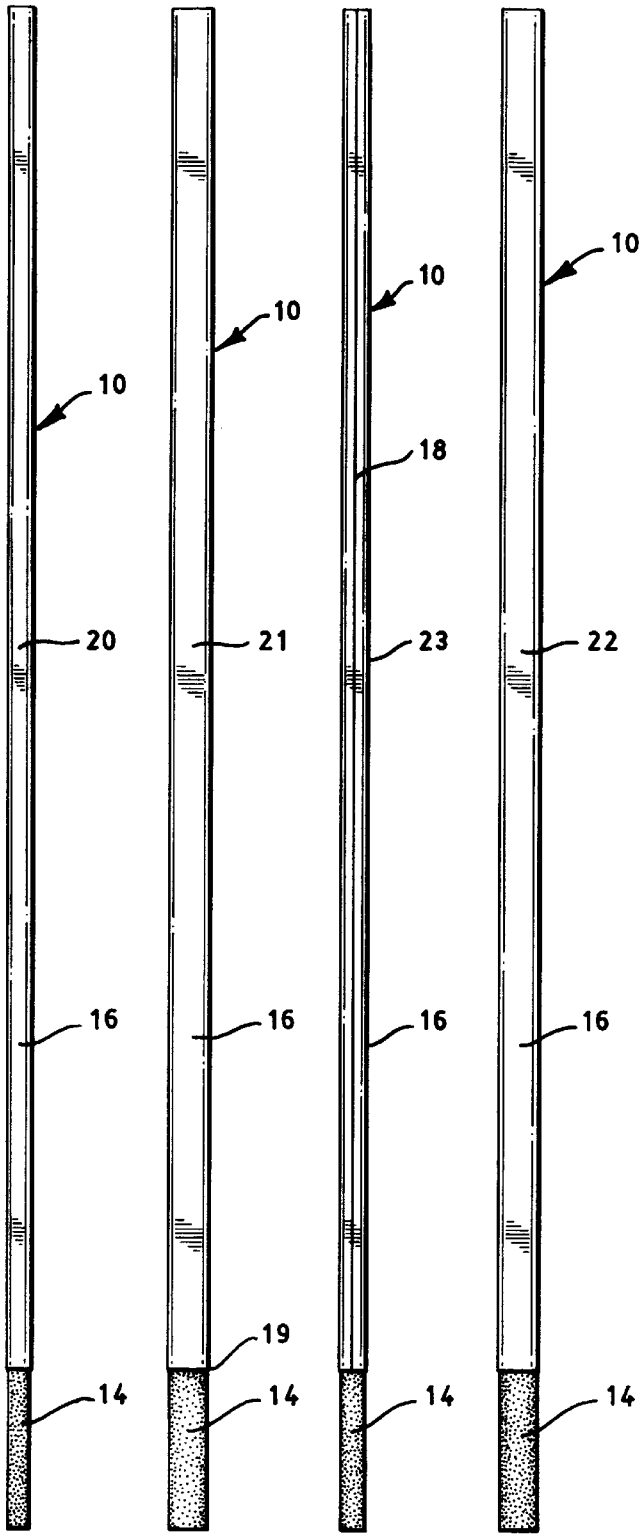
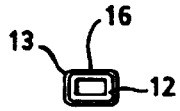
FIG. 6
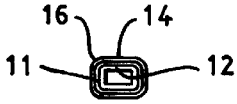
FIG. 7
FIG.2 FIG.3 FIG.4 FIG.5

HOCKEY STICK SHAFT

BACKGROUND OF THE INVENTION (a) Field of the Invention

The present invention relates to a hockey stick shaft, although the shaft could be used with other implements. The shaft includes a core of rectangular cross-section running the full length of the shaft. A cloth fabric is wrapped around the perimeter of the core and extends from the shaft blade end at least partways toward the shaft opposed end. A wood veneer covering is then wrapped around the core/cloth fabric and preferably extends from the shaft opposed blade end at least partways toward the shaft blade end, with a space between the end of the wood veneer and the shaft blade end where the cloth fabric is exposed.

(b) Description of the Prior Art

It is known to provide hockey stick shafts into which a removable blade is attached. There are several ways in which a removable blade is confined within the shaft for play. The blade may have a tenon which contains an adhesive thereon. Generally, the shaft blade insertion end and the blade tenon are heated. With the adhesive softened, the blade tenon is inserted into the shaft blade insertion end. Upon cooling, the adhesive retains the blade tenon within the shaft. The shaft of the present invention is designed to be used with this "hot melt" process.

An alternative to this "hot melt" adhesive is to provide a way to expand the blade tenon once it is inserted into the shaft. This tenon expansion provides for a non-adhesive friction retention of the blade tenon within the shaft. For example, U.S. Pat. No. 5,823,901 teaches a blade with expandable tenon. This blade can also be used with the shaft of the present invention.

U.S. Pat. No. 5,217,221 teaches a hockey stick formed of composite materials. The reference teaches a unitary wood veneer outer layer extending the length of the hockey stick handle.

SUMMARY OF THE INVENTION

The present invention relates to a hockey stick shaft. The shaft includes a core of rectangular cross-section running the full length of the shaft. A cloth fabric, such as an aramid fiber cloth, is wrapped around the perimeter of the core and extends from the shaft blade end at least partways toward the shaft opposed end. DuPont's Kevlar® aramid fiber fabric is the preferred fabric. A wood veneer covering is then wrapped around the core/cloth fabric and preferably extends from the shaft opposed blade end at least partways toward the shaft blade end, with a space between the end of the wood veneer and the shaft blade end where the cloth fabric is exposed. Spacing the wood veneer covering from the blade end permits heat to be applied to the shaft for removal and/or insertion of a "hot melt" blade without damaging the wood veneer. While the preferred removal/insertion method involves the use of a 1200 to 1500 Watt hair dryer, it is known that players use torches having exposed flames to change hot melt blades. Using a torch would cause damage to any wood veneer that the torch flame contacted or to which excessive heat is applied by a hair dryer or other heating appliance.

More particularly, the present invention comprises a hockey stick shaft including a core having a blade end, an opposed end, and a length; a cloth engaging said core and extending from said blade end at least partways toward said opposed end; and, an outer veneer covering, said veneer having a lower end spaced from said blade end.

BRIEF DESCRIPTION OF THE DRAWINGS

A better understanding of the present invention will be had upon reference to the following description in conjunction with the accompanying drawings, wherein:

FIG. 2 is a top side view of the shaft of the first embodiment;

FIG. 3 is a right side view of the shaft of the first embodiment;

FIG. 4 is a bottom side view of the shaft of the first embodiment;

FIG. 5 is a left side view of the shaft of the first embodiment;

FIG. 6 is an end view of the shaft of the first embodiment from the end opposite the blade end;

FIG. 7 is an end view of the shaft of the first embodiment from the blade end;

DETAILED DESCRIPTION OF THE PREFERRED EMBODIMENT

Figure 1:
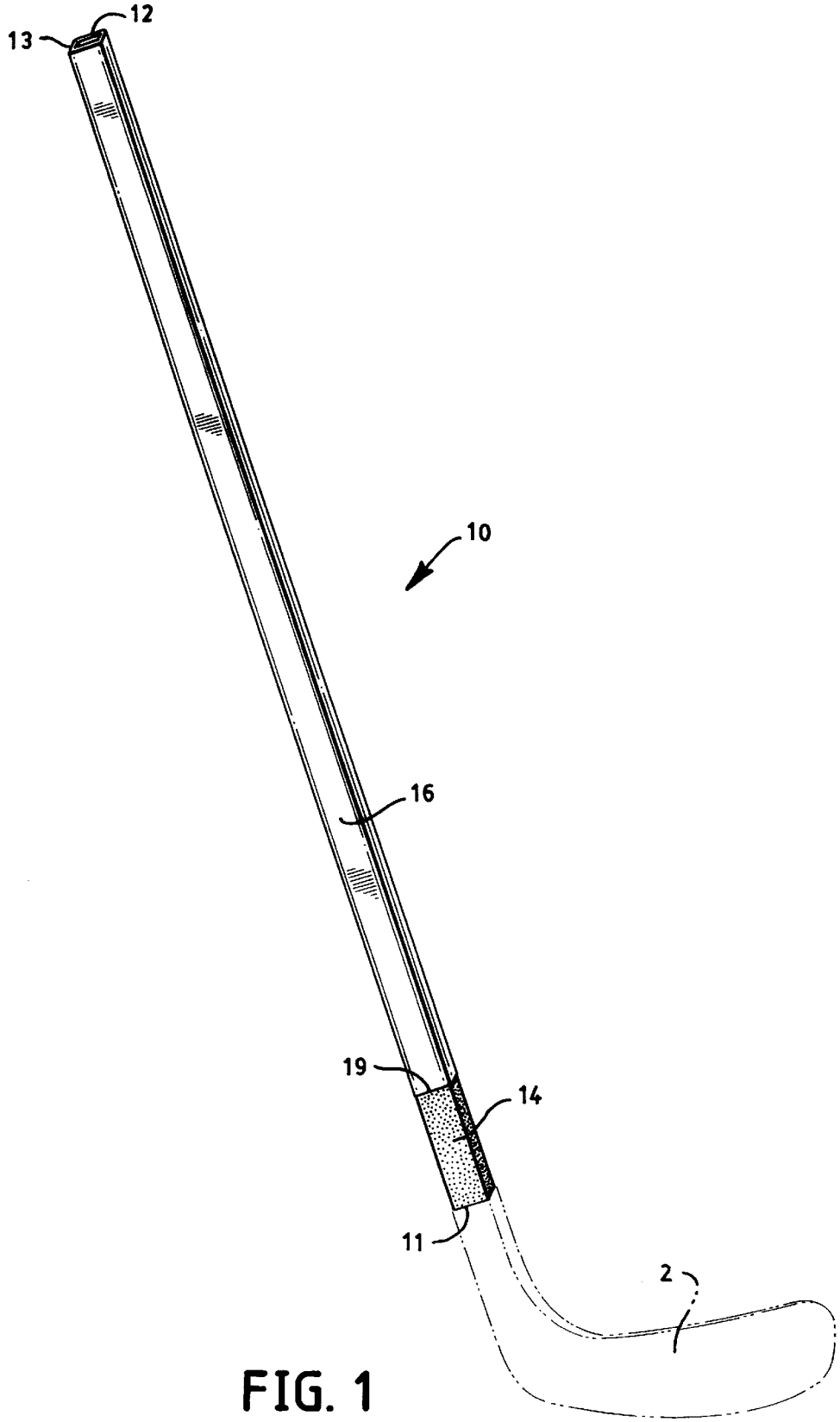
FIG. 1 is a perspective view of the shaft of the first embodiment, the shaft having wood veneer therearound except for a portion of the shaft toward the blade; the broken lines showing a blade inserted into the blade end of the shaft.

With reference to FIGS. 1–13, the shaft 10 of the first embodiment of the instant invention is shown in FIGS. 1–7 and the shaft 100 of the second embodiment is shown in FIGS. 8–13. Shaft 10 and 100 receive a blade 2 therein. As previously mentioned, blade 2 will generally contain a tenon which is received by the blade end 11 of shaft 10 or 100. This tenon is usually of lesser cross-sectional area than the portion of the blade adjacent the tenon. The blade 2 is retained within the shaft using the "hot melt" process or by expanding the tenon for a friction fit after insertion into the shaft, both as explained above. While the shaft 10 or 100 of the present invention was designed for use with the hot melt process, the shaft will receive blades attached thereinto by other methods.

Shafts 10 and 100 include a blade end 11 and an opposed end 13. The shaft 10 or 100 includes a central core 12, which extends the full length of the shaft from end 11 to end 12. Preferably, shaft 10 or 100 is constructed of a plurality of pre-impregnated graphite epoxy layers wrapped about a mandrel to form a hollow shaft having rectangular cross-section. However, core 12 may be made of other known materials, such as wood, metal, or plastic, and be solid or hollow. In general, shaft 10 or 100 will be approximately 48 inches in length.

To strengthen the shaft, there is an additional layer of cloth 14 added to at least the bottom portion of the stick. The cloth material 14 is preferably an aramid fiber, such as KEVLAR® material by DuPont. KEVLAR® material is an industrial textile fiber with high strength and high modulus properties in the form of continuous filament yarns, roving, staple, and pulp. For a 48 inch shaft, the cloth 14 could extend from the blade end 11 a length of from 24 to 48 inches toward the opposed end 13, for example. However, shorter lengths could be used. The inventor believes that a 32 inches length of KEVLAR® material provides good shaft strengthening characteristics and uses a plane weave KEVLAR® pre-impregnated cloth 14 applied with the strands running as a 45° angle to the length of the shaft 10 or 100. This 45° relationship to the core 12 is demonstrated in FIG. 13 by the cross-hatch lines shown on cloth 14. The actual material used has a finer weave.

After the composite lay-up has been rolled up on the mandrel, a piece of wood veneer 16 is draped over the lay-up centered on one small side 20. Preferably, this wood veneer 16 extends the length of the shaft 10 or 100 less approximately four inches on the blade end 11 and is wide enough to wrap around the entire circumference plus about ¼ inch. The lower end of the veneer 16 is identified by the numeral 19. While more or less space than the approximate four inches can be left at the blade end 11, enough space must left so that the veneer 16 will not be damaged by the use of heat or flame at the blade end 11 to remove or insert a blade 2 into the end 11 of shaft 10 or 100. Alternatively, for aesthetics, cloth 14 can be placed at both ends of shaft 10 or 100, either by using multiple pieces of cloth or by using one continuous piece, and the veneer 16 can be spaced from both ends 11 and 13.

Figures 8, 9, 10, 11:
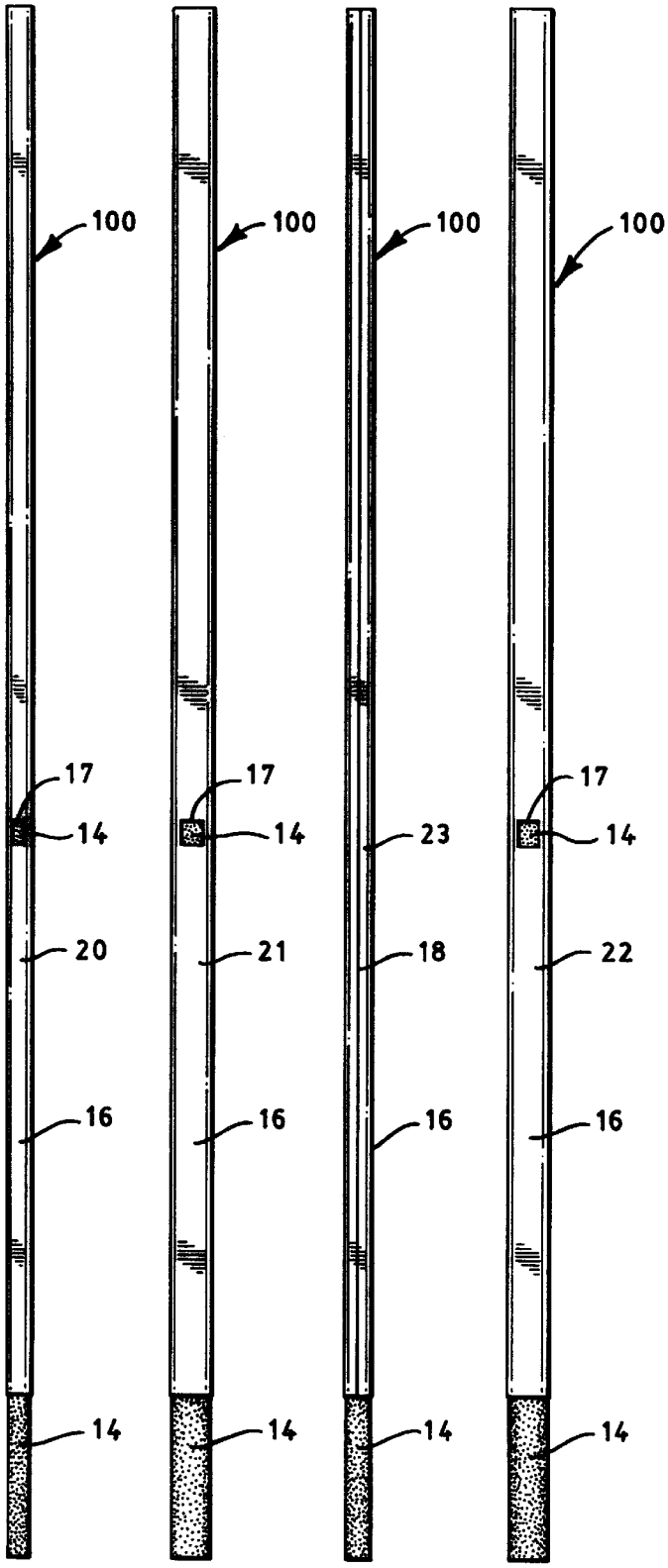
FIG. 8 is a top side view of the shaft of the second embodiment, the wood veneer having cut-out portion at about the mid-point exposing the underneath material.
FIG. 9 is a right side view of the shaft of the second embodiment, the wood veneer having cut-out portion at about the mid-point exposing the underneath material.
FIG. 10 is a bottom side view of the shaft of the second embodiment.
FIG. 11 is a left side view of the shaft of the second embodiment, the wood veneer having cut-out portion at about the mid-point exposing the underneath material.
Figure 12:
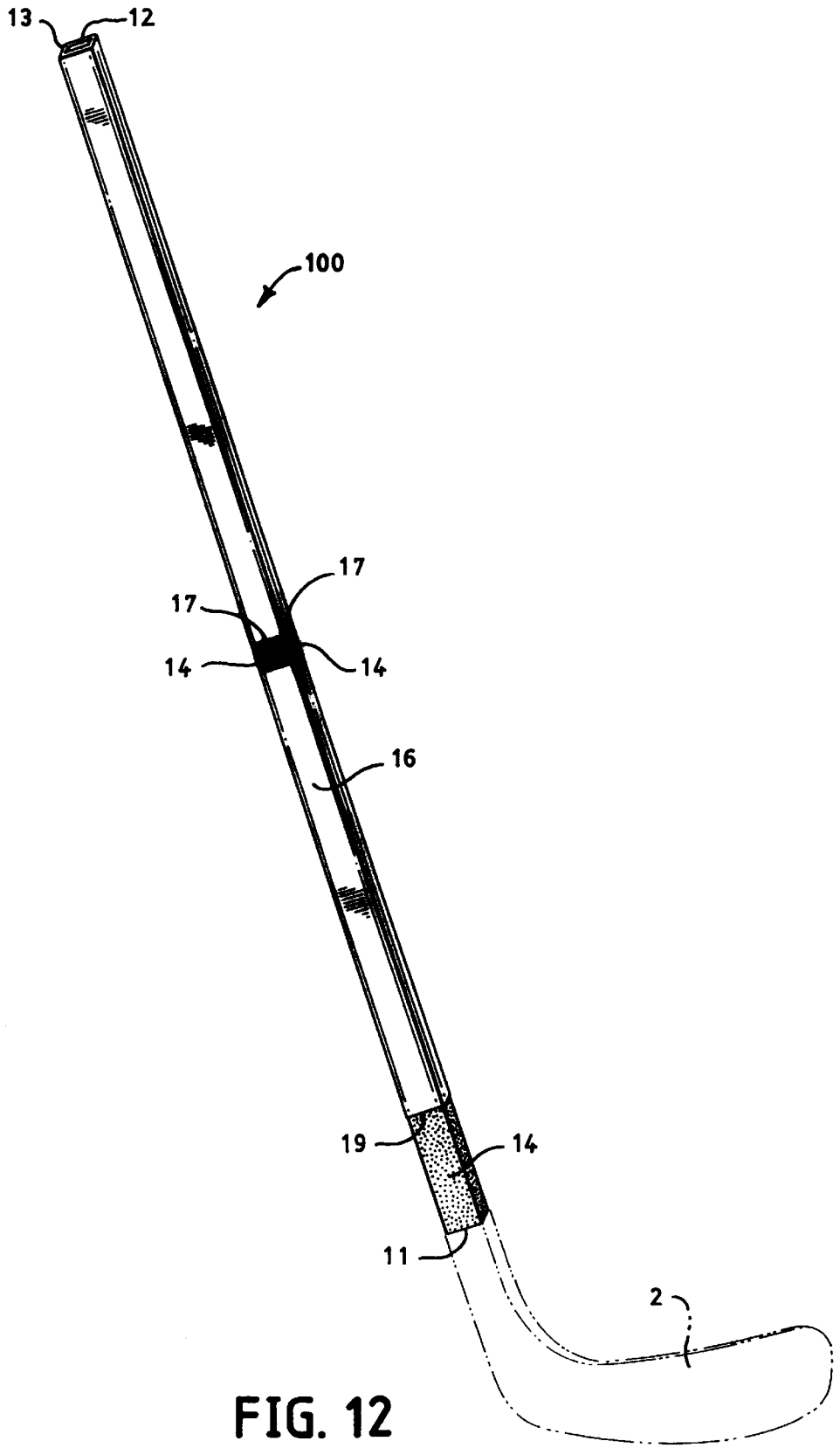
FIG. 12 is a perspective view of the shaft of the second embodiment, the shaft having wood veneer therearound except for a portion of the shaft toward the blade, the wood veneer also having cut-out portions on the shaft top side and right and left sides at about the mid-point exposing the underneath material; the broken lines showing a blade inserted into the blade end of the shaft; the end views of the shaft of the second embodiment being the same as those of the first embodiment shown in FIGS. 6 and 7; and, FIG. 13 shows cross-section views of portions of the upper, middle, and bottom portions of the shaft of the second embodiment.

This lay-up with the wood veneer 16 lying on top of it is placed on top of a ½" wide by ½" high piece of plastic running the length of the lay-up. The plastic piece is attached to a table where a silicon bladder can be placed over it and a vacuum can be pulled under the silicon causing the silicon to suck down forcing the veneer 16 to press in on three sides 20, 21, 22 of the lay-up and attaching itself due to the sticky nature of the pre-impregnation. The piece of plastic prevents the fourth side 23 from being sucked down. The vacuum is then released and the assembly is removed. The wood veneer 16 is then trimmed on the fourth side 23 creating a flush fit on the seam 18, as seen in FIGS. 4 and 10. The assembly is then placed in a bladder inside a pipe-clave for curing.

Figure 13:
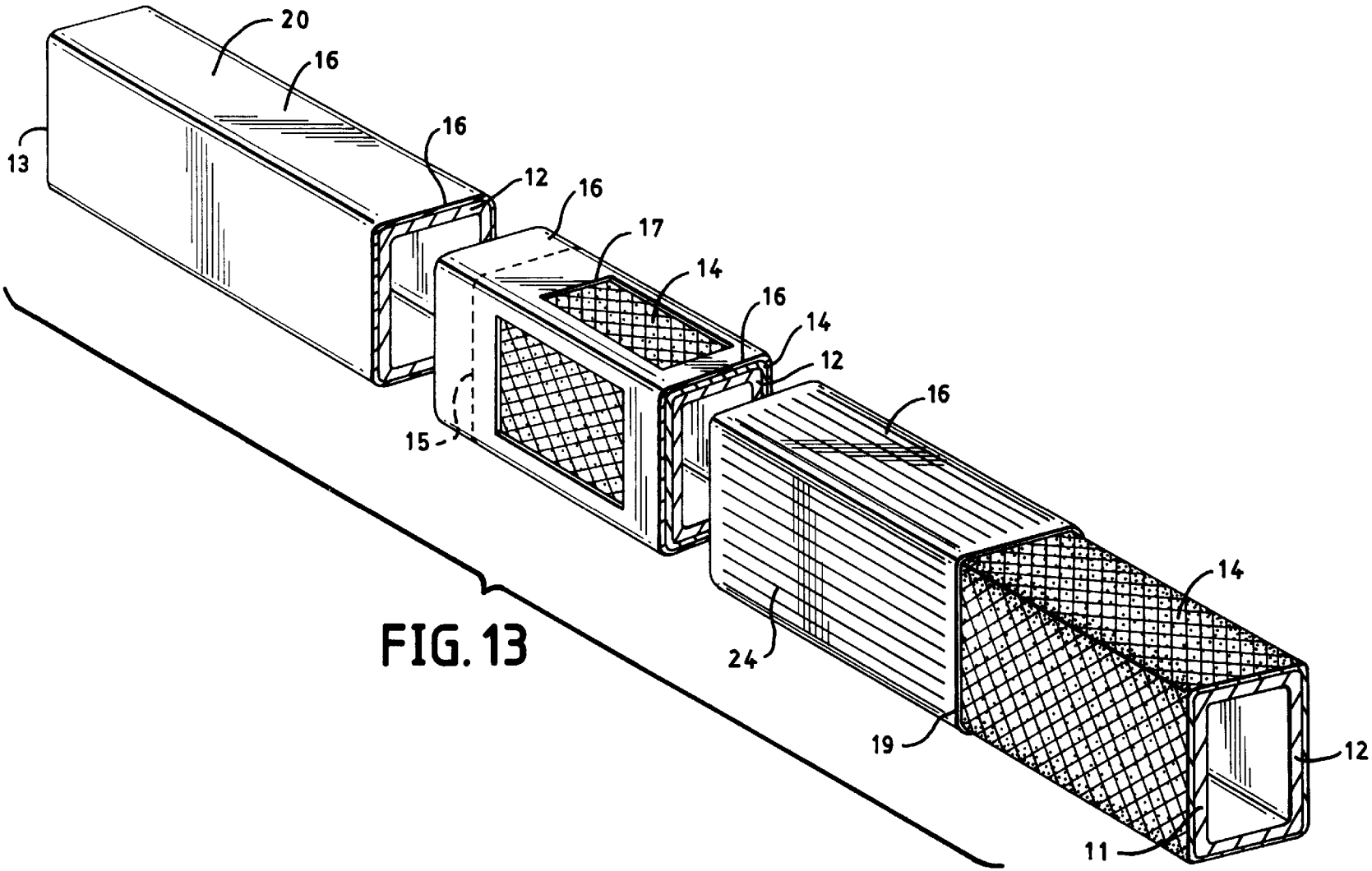

The preferred wood veneer 16 is 0.010 inch thick Cherry with the grain running lengthwise on the shaft 10 or 100. This lengthwise grain orientation is demonstrated by lines 24 on a lower portion of shaft 100 in FIG. 13. With the embodiment of FIGS. 8–13, before the piece of veneer 16 is applied to the shaft 100, three rectangular holes 17 are punched out near the veneer's 16 longitudinal center. These three punch-outs 17 are positioned to center on the top side 20 and the two major sides 20 and 22 of the shaft 100 and are cosmetic. Preferably, cloth 14 extends a sufficient distance from the blade end 11 toward the opposed end 13 so that the cloth 14 is visible through punch-outs 17, as shown in FIGS. 8–13. As seen in FIG. 13, the top end of cloth 14 is indicated by the dotted line 15. Additional or alternative holes or openings of any shape may be punched out of veneer 16 at any desired location. For example, letters or a logo could be punched out.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A hockey stick shaft, comprising:

a. a core having a blade end for receiving a blade therein, an opposed end, and a length;

b. a cloth engaging said core and extending from said blade end at least partways toward said opposed end; and, c. an outer veneer covering, said veneer having a lower end spaced from said blade end.

2. The hockey stick shaft of claim 1, where said cloth wraps around said core.

3. The hockey stick shaft of claim 2, where said cloth is an aramid fiber cloth.

4. The hockey stick shaft of claim 2, where said cloth is KEVLAR® material.

5. The hockey stick shaft of claim 2, where said cloth is a plane weave KEVLAR® pre-impregnated cloth having strands, said cloth being applied with said strands running as a 45-degree angle to said length of said core.

6. The hockey stick shaft of claim 1, where said outer veneer covering extends from said core opposed end.

7. The hockey stick shaft of claim 1, where said outer veneer covering wraps around said core.

8. The hockey stick shaft of claim 1, where said core is constructed of a plurality of pre-impregnated graphite epoxy layers, said core being hollow and having a rectangular cross-section.

9. The hockey stick shaft of claim 1, where said outer veneer covering includes at least one opening therethrough.

10. The hockey stick shaft of claim 9, where said at least one opening is at a location such that said cloth is visible through said at least one opening.

11. The hockey stick shaft of claim 1, where said cloth extends from said blade end for a selected length, said selected length having a value at least equal to said core length divided by two.

12. The hockey stick shaft of claim 1, where said cloth extends from said blade end for 24 to 32 inches and where said core length is approximately 48 inches.

13. The hockey stick shaft of claim 1, where said outer veneer covering is spaced a distance of approximately four inches from said blade end.

14. The hockey stick shaft of claim 9 where said at least one opening comprises three openings, said shaft having a top side, a right side, a left side, and a bottom side, each of said top side, said right side, and said left side having one of said three openings therein.

15. The hockey stick shaft of claim 1, said shaft having a top side, a right side, a left side, and a bottom side, said outer veneer covering having a longitudinal seam along said bottom side.

16. The hockey stick shaft of claim 1, where said outer veneer covering has a grain, said grain running in a direction generally aligned with said blade end and said opposed end.

17. A shaft, comprising:

a. a hollow core having a blade end for receiving a blade therein, an opposed end, and a length, said core having a generally rectangular cross-section;

b. a cloth wrapping around and engaging said core and extending from said blade end at least partways toward said opposed end;

c. an outer veneer covering, said veneer having a veneer lower end spaced a distance from said core blade end and an upper end away from said blade end and said veneer lower end;

d. where said shaft has a top side, a right side, a left side, and a bottom side.

18. The hockey stick shaft of claim 17, where said cloth is a plane weave KEVLAR® pre-impregnated cloth having strands, said cloth being applied with said strands running as a 45-degree angle to said length of said core.

19. The hockey stick shaft of claim 18, where said outer veneer covering includes at least one opening therethrough.

20. The hockey stick shaft of claim 19 where:

a. said at least one opening comprises three openings, each of said shaft top side, said right side, and said left side having one of said three openings therein;

b. where said cloth extends from said blade end for a distance of from about 24 to 32 inches and where said core length is approximately 48 inches; and, c. where said outer veneer covering is spaced a distance of approximately four inches from said blade end.

* * * * *